US009388007B2

(12) United States Patent
Kikuchi

(10) Patent No.: US 9,388,007 B2
(45) Date of Patent: Jul. 12, 2016

(54) SHEET FEEDING APPARATUS

(71) Applicant: CANON KABUSHIKI KAISHA, Tokyo (JP)

(72) Inventor: Tetsuo Kikuchi, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 14/166,565

(22) Filed: Jan. 28, 2014

(65) Prior Publication Data

US 2014/0209653 A1 Jul. 31, 2014

(30) Foreign Application Priority Data

Jan. 30, 2013 (JP) ..... 2013-015300

(51) Int. Cl.
*B65H 23/02* (2006.01)
*B65H 26/00* (2006.01)

(52) U.S. Cl.
CPC ..... *B65H 23/0204* (2013.01); *B65H 26/00* (2013.01); *B65H 2511/242* (2013.01); *B65H 2511/528* (2013.01); *B65H 2513/114* (2013.01); *B65H 2553/414* (2013.01); *B65H 2553/51* (2013.01); *B65H 2553/512* (2013.01); *B65H 2801/09* (2013.01)

(58) Field of Classification Search
CPC .. B65H 26/00; B65H 23/032; B65H 23/0204; B65H 23/0216; B65H 2511/528
See application file for complete search history.

(56) References Cited

U.S. PATENT DOCUMENTS 5,715,071 A * 2/1998 Takashimizu ..... B65H 3/0669 271/117

FOREIGN PATENT DOCUMENTS

JP 2007-245352 A 9/2007

OTHER PUBLICATIONS machine translation of JP 2007-245352, retrieved Nov. 6, 2015.*

* cited by examiner

*Primary Examiner* — Michael McCullough
(74) *Attorney, Agent, or Firm* — Canon U.S.A., Inc. IP Division

(57) ABSTRACT

A sheet feeding apparatus includes a conveyance unit configured to convey a sheet supplied from a holding unit, a sensor configured to detect an edge of the sheet in a width direction, and a control unit configured to detect, with the sensor, a displacement of the edge of the sheet in the width direction during movement of the sheet by a predetermined distance, and to cancel a subsequent skew detection operation if the displacement is larger than an allowable amount.

17 Claims, 16 Drawing Sheets

9
L34
HP
X3
L51
HP
X4
HP
X1
L52
HP
X2

SHEET FEEDING APPARATUS

BACKGROUND OF THE INVENTION

1. Field of the Invention

The present invention relates to a sheet feeding apparatus for feeding sheets.

2. Description of the Related Art

A sheet feeding apparatus for feeding sheets is used in, for example, a recording apparatus that executes recording on recording sheets. There are various types of recording apparatuses for recording on recording sheets, including an ink jet recording apparatus. Among the various recording apparatuses, the ink jet recording apparatus has popularly been used, as it is inexpensive and capable of recording high-quality images on large roll paper.

When roll paper is set in the ink jet recording apparatus, if a leading edge portion of the roll paper is inserted straight with respect to the conveyance direction of conveyance rollers, recording will be normally executed. On the other hand, if the leading edge portion of the roll paper is inserted in a skewed state, the roll paper will not be conveyed straight to cause an image to lie outside the roll paper, resulting in defective recording. A technique to overcome this problem is discussed in Japanese Patent Application Laid-Open No. 2007-245352. Specifically, the width of roll paper is detected at the time of sheet feeding operation executed prior to recording operation, and based on the detected data, if it is determined that defective recording is likely to occur, a message is displayed to prompt the user to reset the roll paper.

In the foregoing technique, the user opens a nip releasing lever for conveyance rollers, inserts roll paper, aligns side edges of the roll paper with a mark indicated on a sheet discharge unit, and then closes the releasing lever to nip the rollers. Then, a reflection type sensor mounted on a carriage, which moves in a direction that is perpendicular to the conveyance direction, measures a position X1 of the sheet side edge. Thereafter, the roll paper is conveyed by about 300 mm, and then a position X2 of the sheet side edge is measured. A difference between the positions X1 and X2 is calculated to obtain a skew amount of the sheet. If the calculated skew amount is smaller than a threshold value, which means that the skew amount is acceptable for recording, the sheet feeding operation is completed. On the other hand, if the skew amount is larger than the threshold value, an error message is displayed to prompt the user to reset the roll paper.

The foregoing technique uses manual sheet feeding. In manual sheet feeding, a user releases the nip of conveyance rollers and aligns a sheet to a mark. In recent years, however, automatic sheet feeding has increasingly been used to reduce user inconvenience. In automatic sheet feeding, a leading edge portion of roll paper is automatically drawn by conveyance rollers. Examples of a method of automatic sheet feeding include a method in which when a sensor disposed near conveyance rollers has detected a leading edge portion of roll paper, the conveyance rollers start rotating. Another example is a method in which when a leading edge portion of roll paper has been inserted between a pair of rollers released from a nip state, the pair of rollers automatically shifts to the nip state to convey the roll paper.

In the automatic sheet feeding, operation procedures are simplified compared with the manual sheet feeding. However, a leading edge portion of roll paper may be drawn before the user thoroughly checks the skew of the roll paper. Thus, the initial skew variability is greater than that in manual sheet feeding. Accordingly, use of a method such as the technique discussed in Japanese Patent Application Laid-Open No. 2007-245352 in which whether image recording can be executed is determined based only on the skew amount of the roll paper may result in frequent error displays. Consequently, the number of times that resetting of the roll paper is required increases to cause user inconvenience. To overcome this problem, an operation is executed to prevent roll paper from being skewed. Specifically, after a leading edge portion of the roll paper is drawn, back tension is applied to the roll paper, and then the roll paper is conveyed by a certain distance (for example, 300 to 400 mm), whereby the skew is reduced. The skew amount is measured thereafter so that the frequency of error displays can be reduced.

However, if the user sets roll paper such that the roll paper is extremely skewed, a leading edge portion of the roll paper may hit a side wall of a conveyance path while being conveyed for skew detection, leading to a paper jam. On the other hand, if the conveyance distance of the roll paper is decreased to avoid a paper jam, the skew detection accuracy decreases to cause a problem of frequent skew errors.

SUMMARY OF THE INVENTION

The present invention is directed to preventing paper jams from occurring while a sheet feeding apparatus for feeding sheets is operating to detect skew of the sheets.

According to an aspect of the present invention, a sheet feeding apparatus includes a conveyance unit configured to convey a sheet supplied from a holding unit, a sensor configured to detect an edge of the sheet in a width direction, and a control unit configured to detect, with the sensor, a displacement of the edge of the sheet in the width direction during movement of the sheet by a predetermined distance, and to cancel a subsequent skew detection operation if the displacement is larger than an allowable amount.

According to exemplary embodiments of the present invention, paper jams can be prevented from occurring during an operation of sheet skew detection.

Further features of the present invention will become apparent from the following description of exemplary embodiments with reference to the attached drawings.

DESCRIPTION OF THE EMBODIMENTS

Figure 1:
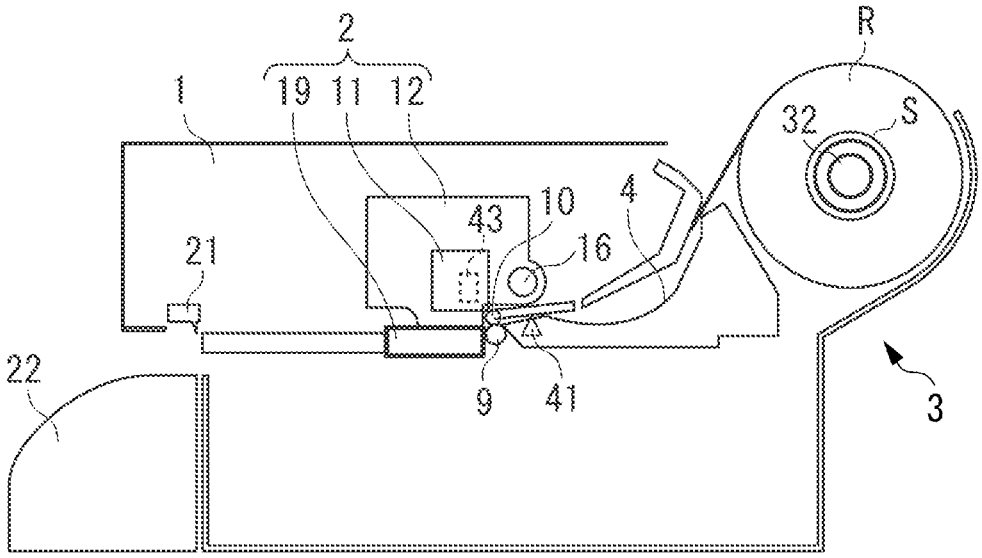
FIG. 1 is a cross sectional view illustrating an image recording apparatus according to a first exemplary embodiment of the present invention.

FIG. 1 is a cross sectional view illustrating an image recording apparatus including a sheet feeding apparatus according to a first exemplary embodiment of the present invention.

Figure 2:
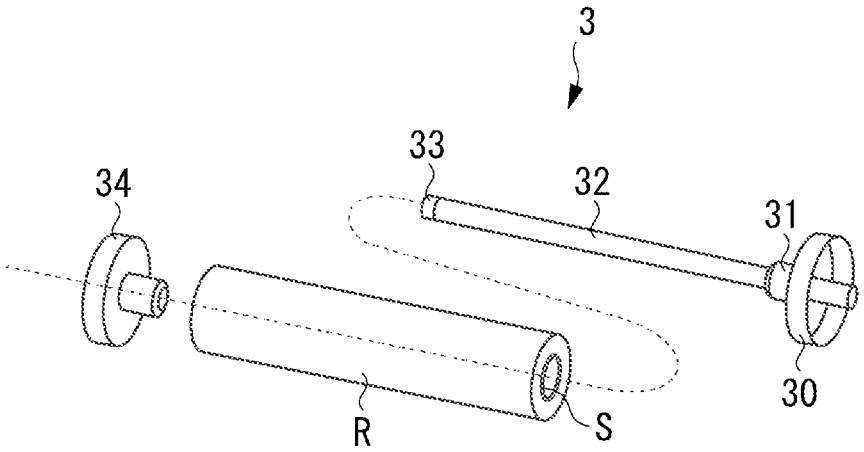
FIG. 2 is a perspective view illustrating a holding unit illustrated in FIG. 1.

In the image recording apparatus illustrated in FIG. 1, a continuous sheet P pulled out from roll paper R is used as a recording medium. The roll paper R includes a paper core S and the continuous sheet P wound around the paper core S. The roll paper R is rotatably held by a holding unit 3 (holding unit) illustrated in FIG. 1. As illustrated in FIG. 2, a spool shaft 32 is inserted in the paper core S. A reference side roll paper holder 30 is attached to one end of the spool shaft 32. The reference side roll paper holder 30 includes a reference side loading unit 31. The reference side loading unit 31 digs into an inner wall of the paper core S due to elastic force in the radial direction, whereby the roll paper R is fixed to the spool shaft 32. Furthermore, a non-reference side roll paper holder 34 is set in the paper core S through the spool shaft 32. As a result, the roll paper R is held between the reference side roll paper holder 30 and the non-reference side roll paper holder 34. A spool gear 33 is attached to the other end of the spool shaft 32.

A leading edge portion of the roll paper R that is rotatably held by the holding unit 3 is pulled out and inserted into a conveyance path 4 as the continuous sheet P. The leading edge portion is conveyed through a sheet detection sensor 41 and then supplied onto a platen 19 such that the leading edge portion is nipped by a pair of line feed (LF) rollers 9 and 10. In the first exemplary embodiment, the pair of LF rollers 9 and 10 functions as a conveyance unit for conveying the roll paper R pulled out from the holding unit 3.

The pair of LF rollers 9 and 10 are in pressure contact with each other due to the urging force of a spring. When the sheet detection sensor 41 detects the leading edge portion of the continuous sheet P, the LF roller 9 rotates so that the leading edge portion of the continuous sheet P is automatically pulled in between the pair of LF rollers 9 and 10. Thereafter, a carriage 12, the pair of LF rollers 9 and 10, and a recording head 11 operate together to record an image on the continuous sheet P.

The carriage 12 is positioned right above the platen 19 and moves in a scanning direction perpendicular to a conveyance direction of the roll paper R. The recording head 11 is mounted on the carriage 12. The carriage 12 is slidably held along a guide shaft 16. Both end portions of the guide shaft 16 are fixed to a frame of a main body 1. After the roll paper R is conveyed to an image recording unit 2, the carriage 12 reciprocates in the scanning direction. While the carriage 12 is reciprocating, the recording head 11 discharges ink, whereby an image of one line is recorded on the continuous sheet P. When the image of one line is recorded, the pair of LF rollers 9 and conveys the continuous sheet P in the conveyance direction by a predetermined pitch. Thereafter, the carriage 12 reciprocates again in the scanning direction so that the recording head 11 records an image of the subsequent line. The foregoing operation is repeated to record images on the entire page.

A sheet edge detection sensor 43 is attached to a side surface of the carriage 12. The sheet edge detection sensor 43 includes a reflection type optical sensor. The sheet edge detection sensor 43 operates in coordination with the scanning movement of the carriage 12 to detect the leading edge portion of the continuous sheet P, and the position of an edge of the continuous sheet P in a width direction. The position of the carriage 12 is detected by a linear encoder 44 (FIG. 5) so that position information of an edge of the continuous sheet P can be obtained from a count value of the linear encoder 44 at the time of detection of the edge of the continuous sheet P by the sheet edge detection sensor 43. The position information of the edge of the continuous sheet P is the counter value of the encoder or a value obtained by converting the count value into a length.

The continuous sheet P on which the images have been recorded is conveyed onto a sheet discharge tray 22. When the image recording is finished, a trailing edge portion of the image is conveyed to a cutter 21 by the pair of LF rollers 9 and 10. The cutter 21 cuts the trailing edge portion of the images on the continuous sheet P.

Figure 3:
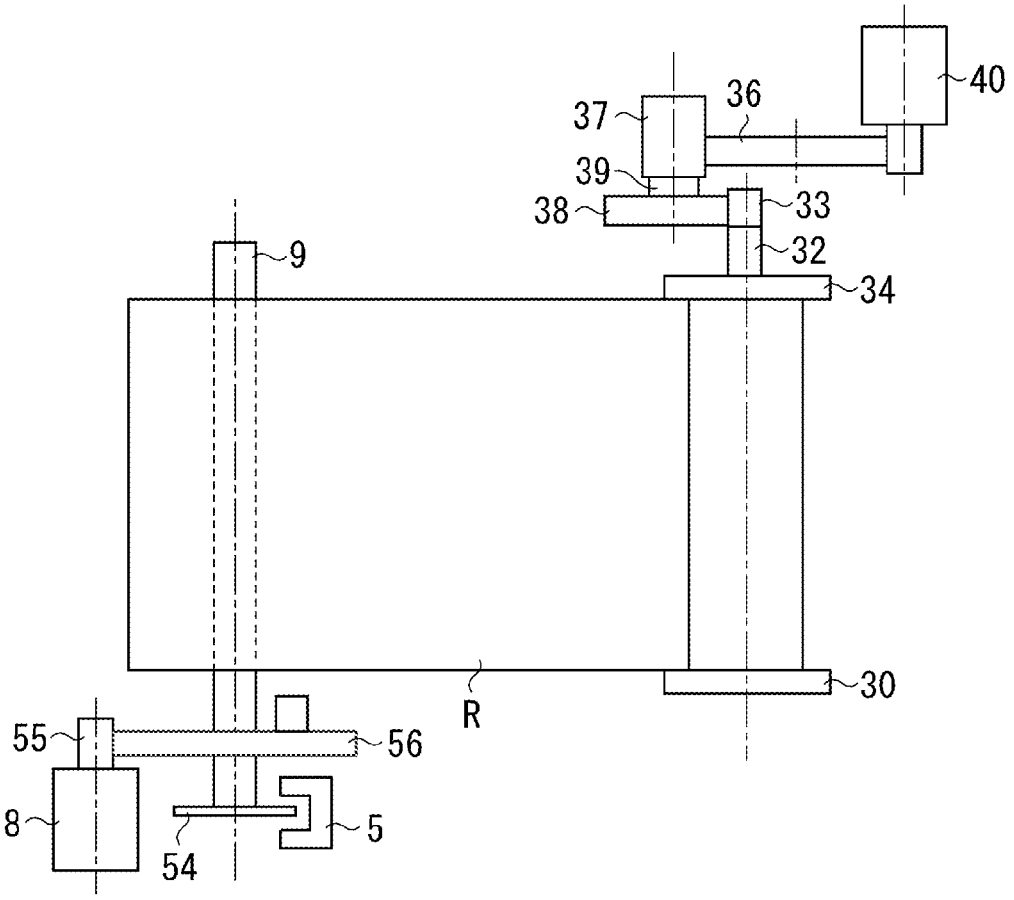
FIG. 3 is a top view illustrating a driving mechanism of an LF roller and a driving mechanism of a spool shaft.

FIG. 3 is a top view illustrating driving mechanisms of the LF roller 9 and the spool shaft 32.

First, the driving mechanism of the LF roller 9 will be described. The power of an LF motor 8 is transmitted to the LF roller 9 via LF transmission gears 55 and 56. A circular LF encoder film 54 is attached to the LF roller 9. The LF encoder film 54 includes slits formed radially. The LF encoder sensor 5 detects the slits to detect the rotation rate and rotation amount of the LF roller 9.

Next, the driving mechanism of the spool shaft 32 will be described. The power of a roll motor 40 is transmitted to the spool gear 33 via a roll transmission gear 36 and gears 37 and 38. A torque limiter 39 is provided between the gears 37 and 38. When the LF roller 9 conveys the continuous sheet P in the conveyance direction while the roll motor 40 locks its rotation, the torque limiter 39 applies back tension to the continuous sheet P. The LF motor 8 and the roll motor 40 rotate in a direction that is opposite to the direction in which the continuous sheet P is conveyed, whereby the roll paper R can be wound back while back tension is applied.

If the leading edge portion of the continuous sheet P that is skewed is inserted into the pair of LF rollers 9 and 10 and conveyed, the continuous sheet P comes to a so-called skew state. However, if the continuous sheet P continues to be conveyed while being pulled with back tension applied thereto, the skew state is corrected.

In the image recording apparatus according to the first exemplary embodiment, a user inserts the leading edge portion of the continuous sheet P pulled out from the roll paper R into the conveyance path 4. When the sheet detection sensor 41 detects the leading edge portion of the inserted continuous sheet P, the LF roller 9 starts rotating so that the leading edge portion of the continuous sheet P is automatically pulled in.

At this time, if the user inserts the leading edge portion of the continuous sheet P in a skewed state with respect to the conveyance direction, the pair of LF rollers 9 and 10 is likely to convey the roll paper R in a skew state. If the image recording unit 2 executes recording on the roll paper R that is in the skew state, an image may lie outside the continuous sheet P. Thus, the image recording apparatus according to the first exemplary embodiment calculates the skew amount after conveying the continuous sheet P by a certain distance and then executes skew detection to determine whether the calculated skew amount is within an allowable range for execution of image recording.

However, if a user inserts the continuous sheet P into the conveyance path 4 in an extremely skewed state, the leading edge portion of the roll paper R is likely to hit a wall of a sheet guide member of the platen 19 or a wall of a sheet discharge tray 22 to cause a paper jam and wrinkles due to the paper jam during the skew detection operation.

Hence, the image recording apparatus according to the first exemplary embodiment executes a preceding skew detection operation (first skew detection operation) prior to a normal skew detection operation (second skew detection operation). If the continuous sheet P is skewed with an amount that is larger than an allowable amount in the preceding skew detection operation, the image recording apparatus gives a notification to prompt the user to reset the continuous sheet P to prevent paper jams and wrinkles.

Details of the first skew detection operation and the second skew detection operation will be described with reference to FIGS. 7A, 7B, 7C, 7D, 8A, 8B, and 8C. FIGS. 7A, 7B, 7C, and 7D are top views illustrating positions at which the continuous sheet P is detected in the first skew detection operation and the second skew detection operation. FIGS. 8A, 8B, and 8C are cross sectional views illustrating conveyance states of the continuous sheet P that correspond to the first skew detection operation and the second skew detection operation.

First, the preceding skew detection operation will be described. When the leading edge portion of the continuous sheet P is pulled in between the pair of LF rollers 9 and 10, the pair of LF rollers 9 and 10 conveys the leading edge portion of the continuous sheet P onto the platen 19 (refer to FIG. 8A). Then, the carriage 12 starts moving in the scanning direction, and the sheet edge detection sensor 43 detects an edge position X3 of the continuous sheet P in the width direction (refer to FIG. 7A). The edge position X3 is the position of an edge of the holding unit 3 that is on the reference side roll paper holder 30 side illustrated in FIG. 2. The position information X3 is, for example, a numerical value corresponding to the distance from a reference position HP (home position). The position information may be a value obtained from the count value of the linear encoder 44 for detecting the position of the carriage 12, or a value obtained by converting the calculated value into a distance in International System of Units (SI) unit system. This also applies to edge position information and skew amount to be described below.

After the detection by the sheet edge detection sensor 43, the pair of LF rollers 9 and 10 moves the leading edge portion of the continuous sheet P in the conveyance direction by a predetermined distance L34 (first distance) (refer to FIG. 8B). After the continuous sheet P is moved by the predetermined distance, the sheet edge detection sensor 43 measures an edge position X4 of the continuous sheet P again (refer to FIG. 7B). In the first exemplary embodiment, a difference between the edge position X3 of the continuous sheet P before the movement and the edge position X4 of the continuous sheet P after the movement is a first skew amount (first displacement amount) X34. The skew amount is the amount (distance) of displacement of an edge of the continuous sheet P in the width direction after the continuous sheet P is moved by a predetermined distance. If the first skew amount X34 is larger than a threshold value S34A (first threshold value), the pair of LF rollers 9 and 10 and the holding unit 3 wind back the continuous sheet P to the roll paper R. Then, the subsequent skew detection operation to be performed is cancelled. Thereafter, a display unit 7 (refer to FIG. 5), which serves as a notification unit, displays a notification to prompt the user to reset the roll paper R. The state in which the first skew amount X34 is larger than the threshold value S34A indicates that a problem such as a paper jam is more likely to occur when the continuous sheet P is conveyed in the skew detection operation to be described below.

If the first skew amount X34 is equal to or smaller than the threshold value S34A, the skew detection operation is executed. In the skew detection operation, the pair of LF rollers 9 and 10 moves the leading edge portion of the continuous sheet P in the conveyance direction by a distance L51 (second distance) (refer to FIG. 8C). After the conveyance of the continuous sheet P, the sheet edge detection sensor 43 detects an edge position X1 of the continuous sheet P (refer to FIG. 7C). Thereafter, the leading edge portion of the continuous sheet P is conveyed by a distance L52, which is equal to the distance L51, in a direction that is opposite to the conveyance direction. Then, the sheet edge detection sensor 43 detects an edge position X2 of the continuous sheet P in the width direction (refer to FIG. 7D). A displacement amount before and after the movement, which is a difference between the edge position X1 of the continuous sheet P and the edge position X2 of the continuous sheet P, is a second skew amount X12 detected in the second skew detection operation. If the second skew amount X12 is smaller than a threshold value S12, it is determined that image recording can be executed. The threshold value S12 is an allowable value of skew amount for normal image recording. On the other hand, if the skew amount X12 is equal to or larger than the threshold value S12, the pair of LF rollers 9 and 10 and the holding unit 3 wind back the continuous sheet P to the roll paper R. Then, the display unit 7 (refer to FIG. 5) displays a notification to prompt the user to reset the roll paper R. This skew detection operation enables normal image recording to be performed without causing an image to lie outside the continuous sheet P.

In the skew detection operation described above, the sheet edge detection sensor 43 detects the edge position X2 after the continuous sheet P is wound back to the roll paper R. In the first exemplary embodiment, however, the sheet edge detection sensor 43 may detect the edge position X2 after the continuous sheet P is conveyed further in the conveyance direction. Alternatively, the sheet edge detection sensor 43 may detect the edge position X2 after the continuous sheet P is reciprocated in the conveyance direction and the opposite direction.

Figure 4:
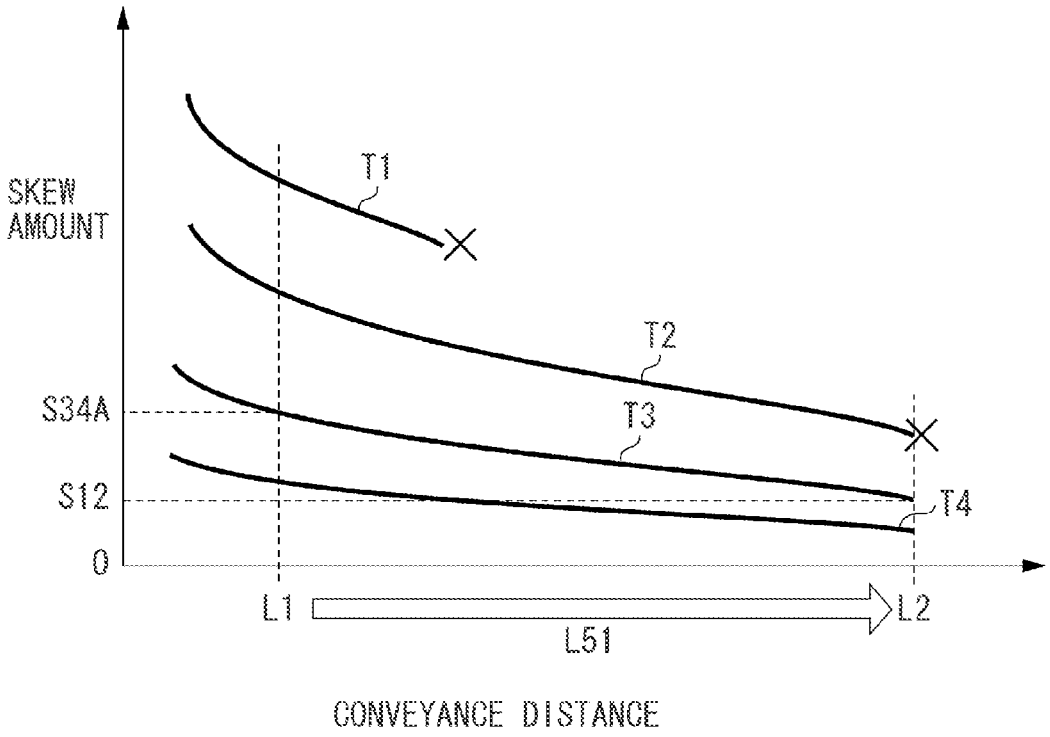
FIG. 4 is a figure illustrating a relationship between a conveyance distance of a continuous sheet P and a skew amount of the continuous sheet P.

The threshold values S12 and S34A are set based on a transition of the skew state of the continuous sheet P conveyed in the skew detection operation. FIG. 4 illustrates the relationship between the conveyance distance and skew amount of the continuous sheet P. In FIG. 4, a line T1 indicates the case in which a paper jam occurs while the continuous sheet P is conveyed in the skew detection operation. A line T2 indicates the case in which no paper jam occurs but a skew error occurs in the skew detection operation. A line T3 indicates the limit case in which in the skew detection operation it can be determined that image recording can be executed. A line T4 indicates the case in which the skew amount is so small that image recording can be satisfactorily executed. In the first exemplary embodiment, the threshold values S12 and S34A are set based on the case indicated by the line T3.

Figure 5:
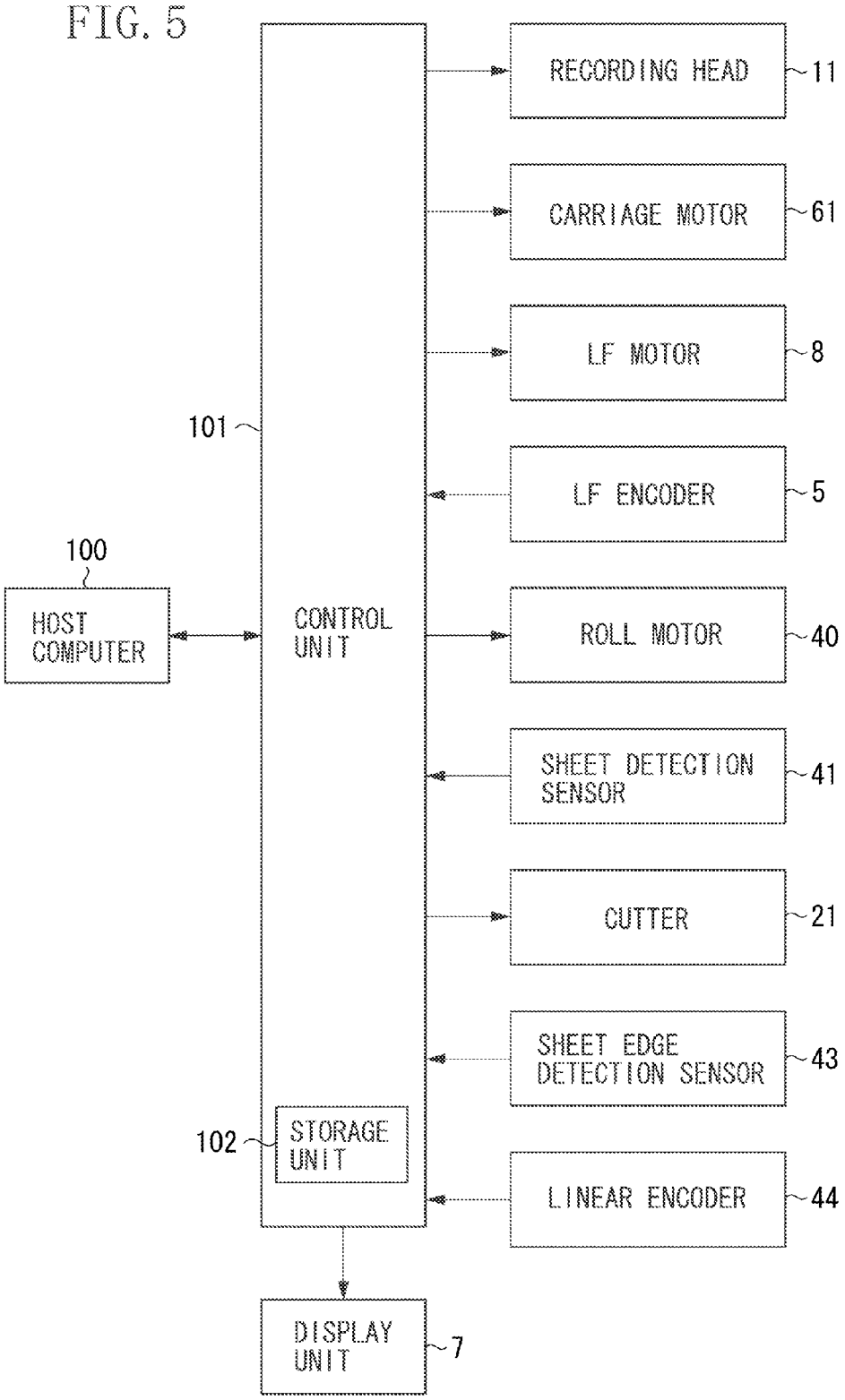
FIG. 5 is a block diagram illustrating an electric control configuration of the image recording apparatus illustrated in FIG. 1.

FIG. 5 is a block diagram illustrating the electric control configuration of the image recording apparatus illustrated in FIG. 1.

A control unit 101 included in the main body 1 is connected to a host computer 100 via an interface (not illustrated). The host computer 100 transfers image data and data associated with recording to the control unit 101 via the interface. The control unit 101 executes processing on the image data such as color processing, reduction/enlargement processing, and binarization. Further, the control unit 101 stores recording data converted into dot patterns in a storage unit 102 therein. In response to signals from an LF encoder 5, the sheet detection sensor 41, a roll detection sensor 42, and the sheet edge detection sensor 43, the control unit 101 controls the LF motor 8, the roll motor 40, a carriage motor 61 for moving the carriage 12, and the cutter 21.

Figure 6:
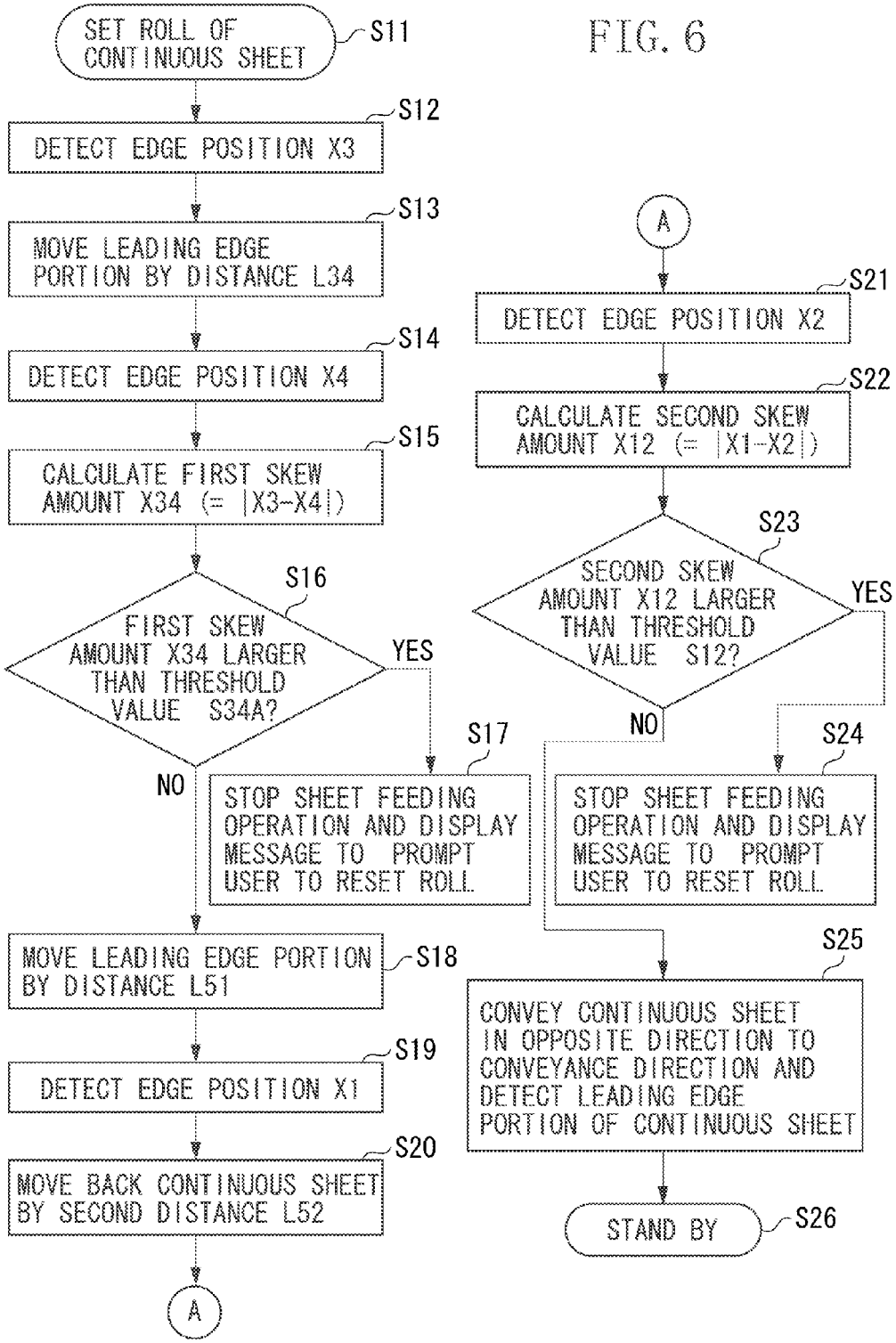
FIG. 6 is a flowchart illustrating a procedure of sheet feeding operation by the image recording apparatus according to the first exemplary embodiment.

Next, the sheet feeding operation by the image recording apparatus according to the first exemplary embodiment will be described. FIG. 6 is a flowchart illustrating a procedure of the sheet feeding operation by the image recording apparatus according to the first exemplary embodiment. The flowchart in FIG. 6 illustrates a procedure of the preceding skew detection operation and a procedure of the skew detection operation. The operation of each unit described below is executed according to the control of the control unit 101.

First, the operation in step S11 (roll paper setting) will be described. A user sets the roll paper R including the continuous sheet P onto the holding unit 3, pulls out the continuous sheet P from the roll paper R, and inserts the leading edge of the continuous sheet P into the conveyance path 4. When the sheet detection sensor 41 detects the leading edge portion of the continuous sheet P inserted in the conveyance path 4 by the user, the LF motor 8 starts rotating. The rotation of the LF motor 8 causes the pair of LF rollers 9 and 10 to nip the leading edge portion of the continuous sheet P and start conveying the continuous sheet P. When the leading edge portion of the continuous sheet P arrives at the platen 19 and is detected by the sheet edge detection sensor 43, the pair of LF rollers 9 and 10 conveys the continuous sheet P by a predetermined distance (30 mm in the first exemplary embodiment) (refer to FIG. 8A). Then, the LF motor 8 stops.

In step S12, the carriage motor 61 rotates to move the carriage 12 in the scanning direction so that the sheet edge detection sensor 43 detects the edge position X3 (refer to FIG. 7A) of the continuous sheet P.

In step S13, after the detection of the edge position X3, the LF motor 8 rotates so that the pair of LF rollers 9 and 10 moves the leading edge portion of the continuous sheet P in the conveyance direction by a distance L34 (50 mm in the first exemplary embodiment). When the conveyance of the continuous sheet P is completed, the LF motor 8 stops.

Figures 7A, 7B, 7C, 7D:
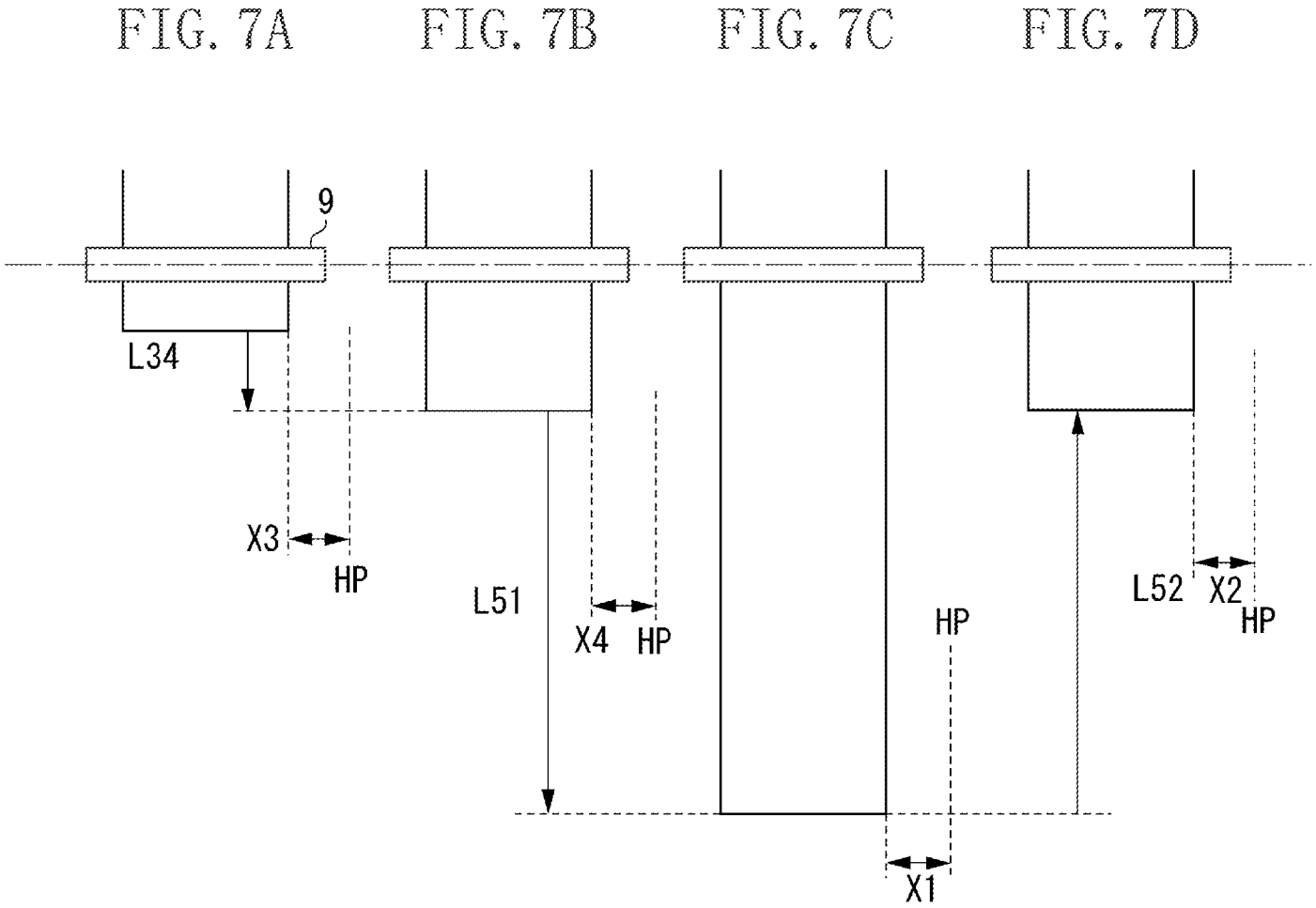
FIGS. 7A, 7B, 7C, and 7D are top views illustrating detection positions of the continuous sheet P in a preceding skew detection operation and a skew detection operation.
Figure 8A:
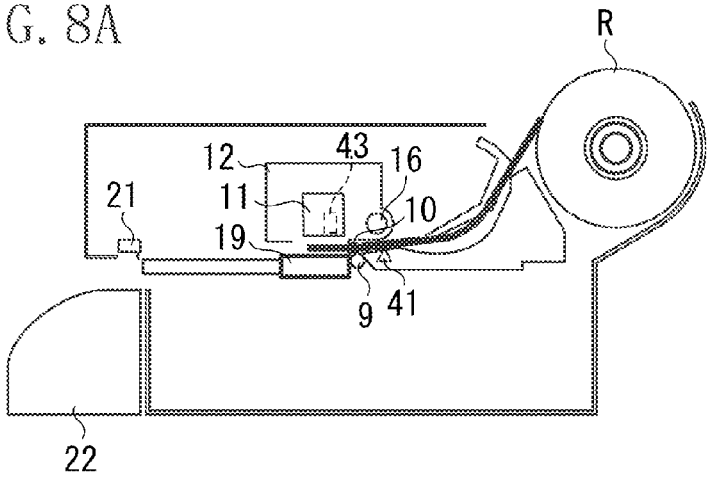
FIGS. 8A and 8B, and 8C are cross sectional views illustrating conveyance states of roll paper that correspond to the preceding skew detection operation and the skew detection operation.
Figure 8B:
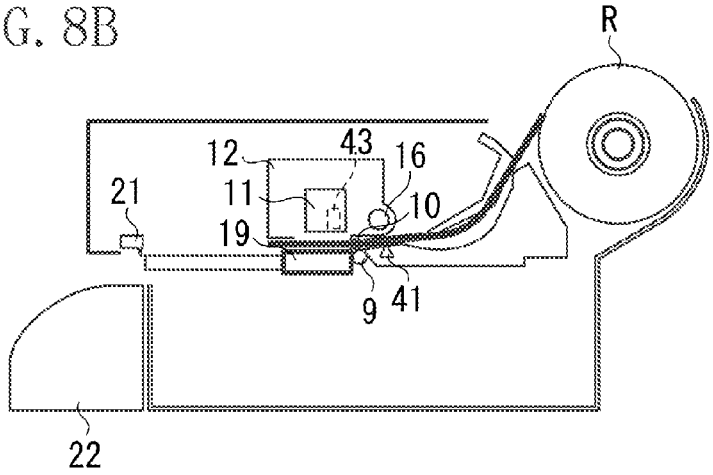
Figure 8C:
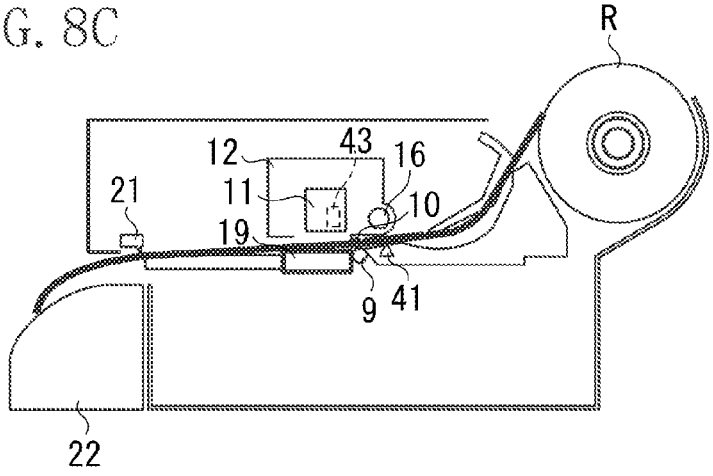

In step S14, the carriage motor 61 rotates to move the carriage 12 in the scanning direction so that the sheet edge detection sensor 43 detects the edge position X4 (refer to FIG. 7B).

In step S15, after the detection of the edge position X4, the control unit 101 calculates a difference between the edge position X3 and the edge position X4 to obtain a first skew amount (first displacement amount) X34. In step S16, the control unit 101 determines whether the first skew amount X34 is larger than a threshold value S34A (2.0 mm in the first exemplary embodiment).

If the first skew amount X34 is larger than the threshold value S34A (YES in step S16), the control unit 101 determines that a paper jam is more likely to occur when the skew detection operation is executed. In step S17, the control unit 101 stops the sheet feeding operation and displays on the display unit 7 a message to prompt the user to reset the roll paper R.

On the other hand, if the first skew amount X34 is equal to or smaller than the threshold value S34A (NO in step S16), the control unit 101 determines that defective sheet feeding such as a paper jam is unlikely to occur even when execution of the sheet feeding operation is continued. Thus, execution of the sheet feeding operation is continued. According to a line T3 illustrated in FIG. 4, if the first skew amount X34 is equal to the threshold value S34A, it is determined in the skew detection operation executed following the preceding skew detection operation that image recording can be executed. Thus, omitting the skew detection operation may be considered. However, the threshold value S34A is not a uniquely determined value but variable. Hence, in the first exemplary embodiment, the skew detection operation is executed to make a final determination about whether the skew state is acceptable for execution of image recording.

In step S18 following step S17, as illustrated in FIG. 8C, the LF motor 8 rotates so that the pair of LF rollers 9 and 10 moves the leading edge portion of the continuous sheet P by a distance L51 (300 mm in the present exemplary embodiment). In this step, the torque limiter 39 brakes the rotation of the spool shaft 32 so that back tension is applied to the continuous sheet P to correct a positional bias or skew of the continuous sheet P. Thereafter, the second skew detection operation is started.

In step S19, after the conveyance of the continuous sheet P, the carriage motor 61 rotates to move the carriage 12 in the scanning direction. At this time, the sheet edge detection sensor 43 detects the edge position X1 (refer to FIG. 7C).

In step S20, after the detection of the edge position X1, the LF motor 8 is reversed to reverse the LF roller 9, whereby the continuous sheet P is moved back by the second distance L52 (300 mm in the first exemplary embodiment). The value of the second distance L52 is set larger than the first distance L34, which is a predetermined distance.

In step S21, the carriage motor 61 rotates to move the carriage 12 in the scanning direction so that the sheet edge detection sensor 43 detects the edge position X2 (refer to FIG. 7D).

In step S22, after the detection of the edge position X2, the control unit 101 calculates a difference between the edge position X1 and the edge position X2 to obtain the second skew amount X12 (second displacement amount). In step S23, the control unit 101 determines whether the second skew amount X12 is larger than the threshold value S12 (1.0 mm in the first exemplary embodiment). The threshold value S12 is set smaller than the threshold value S34A.

If the second skew amount X12 is larger than the threshold value S12 (YES in step S23), the control unit 101 determines that an image is more likely to lie outside the roll paper R. In step S24, the control unit 101 stops the sheet feeding operation and displays on the display unit 7 a message to prompt the user to reset the roll paper R.

If the second skew amount X12 is equal to or smaller than the threshold value S12 (NO in step S23), the control unit 101 determines that image recording can be normally executed in the recording operation.

Then, the carriage 12 moves the sheet edge detection sensor 43 to a position at which the sheet edge detection sensor 43 can detect the leading edge portion of the continuous sheet P. Thereafter, the pair of LF rollers 9 and 10 conveys the continuous sheet P in the direction that is opposite to the conveyance direction. When the sheet edge detection sensor 43 detects the leading edge portion of the continuous sheet P, the pair of LF rollers 9 and 10 stops to end the sheet feeding operation.

As described above, the image recording apparatus according to the first exemplary embodiment executes the preceding skew detection operation prior to the skew detection operation that determines whether the skew state of the continuous sheet P is acceptable for image recording. In the preceding skew detection operation, the continuous sheet P is conveyed by a shorter distance than that in the skew detection operation to calculate the skew amount. Thus, even when the user inserts the continuous sheet P that is greatly skewed into the conveyance path 4, the skew state that is likely to result in defective sheet feeding such as a paper jam can be detected at an early stage prior to the skew detection operation, which is an initial stage of the sheet feeding operation. Furthermore, since a conveyance distance that is necessary for the calculation of an accurate skew amount is set in the skew detection operation executed following the preceding skew detection operation, the frequency of occurrence of skew errors can be decreased.

An image recording apparatus according to a second exemplary embodiment of the present invention will be described. Points that are different from those of the image recording apparatus according to the first exemplary embodiment will mainly be described below.

Two threshold values to be used in the preceding skew detection operation are set in the image recording apparatus according to the second exemplary embodiment. A threshold value 34A, which is one of the two threshold values, is the threshold value S34A described in the first exemplary embodiment. A threshold value S34B, which is the other of the two threshold values, is a value that is set to skip the skew detection operation.

Figure 9:
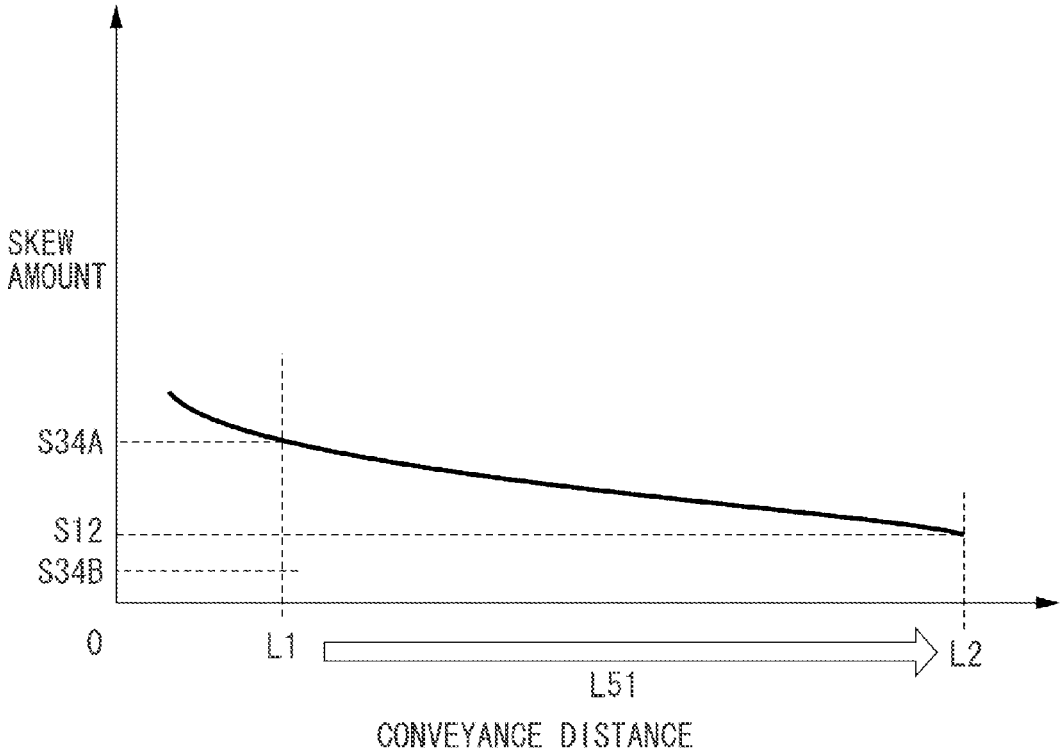
FIG. 9 is a figure illustrating a relationship between a conveyance distance of a continuous sheet P and a skew amount of the continuous sheet P.

FIG. 9 is a figure illustrating a relationship between the conveyance distance and skew amount of the continuous sheet P. As illustrated in FIG. 9, as the continuous sheet P is conveyed, the skew amount decreases. The threshold value S34A (first threshold value) shown in FIG. 9 is a reference value for determining in the first skew detection operation whether the second skew detection operation can be executed. The threshold value S12, which is smaller than the threshold value S34A, is a reference value for determining in the second skew detection operation whether the image recording can be executed. The threshold value S34B (second threshold value), which is smaller than the threshold value S12, is a value that allows a determination to be made about whether the image recording can be executed, only through the first skew detection operation and without the second skew detection operation.

Figure 10A:
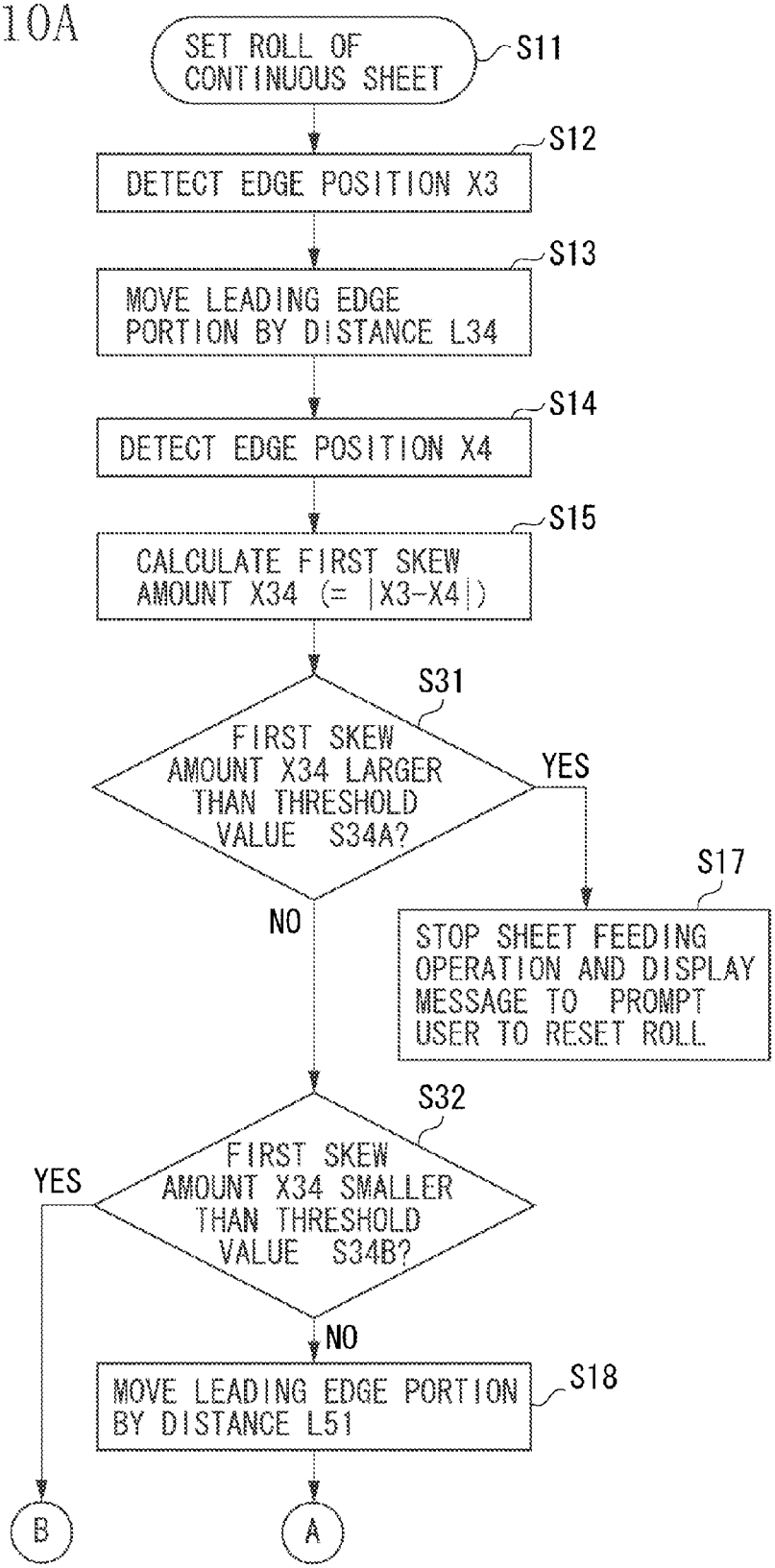
FIGS. 10A and 10B are a flowchart illustrating a procedure of sheet feeding operation by an image recording apparatus according to a second exemplary embodiment of the present invention.
Figure 10B:
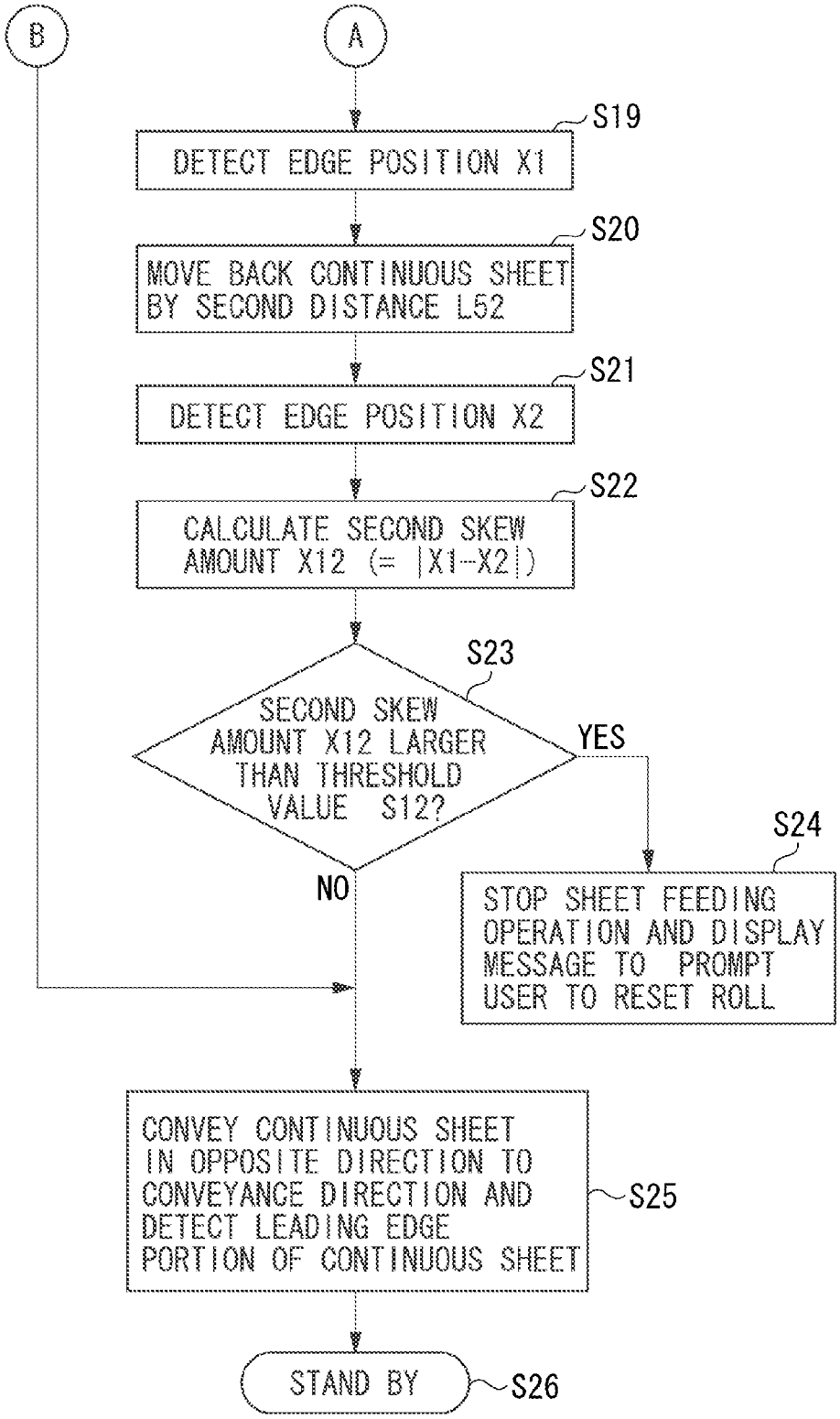

FIGS. 10A and 10B are a flowchart illustrating a procedure of the sheet feeding operation by the image recording apparatus according to the second exemplary embodiment. Steps S11 to S15 and S18 to S24 in the flowchart illustrated in FIGS. 10A and 10B are similar to those of the first exemplary embodiment, so the description thereof is omitted.

In step S31, after the control unit 101 calculates the first skew amount X34 (first displacement amount) in step S15, the control unit 101 determines whether the first skew amount X34 is larger than a threshold value S34A. In the second exemplary embodiment, the threshold value S34A is 2.0 mm.

If the first skew amount X34 is larger than the threshold value S34A (YES in step S31), the control unit 101 determines that a paper jam is more likely to occur when the second skew detection operation is executed. In step S17, the control unit 101 stops the sheet feeding operation and displays on the display unit 7 a message to prompt the user to reset the roll paper R.

On the other hand, if the first skew amount X34 is equal to or smaller than the threshold value S34A (NO in step S31), then in step S32, the control unit 101 determines whether the first skew amount X34 is smaller than a threshold value S34B. In the second exemplary embodiment, the threshold value S34B is 0.16 mm.

If the first skew amount X34 is smaller than the threshold value S34B (YES in step S32), the control unit 101 determines that even if the second skew detection operation is not executed, no defective recording will occur. Thus, the control unit 101 proceeds to the operation in step S25 to end the sheet feeding operation. On the other hand, if the first skew amount X34 is equal to or larger than the threshold value S34B (NO in step S32), the control unit 101 executes the skew detection operation in steps S18 to S24.

As described above, the image recording apparatus according to the second exemplary embodiment executes the preceding skew detection operation as in the first exemplary embodiment so that a paper jam can be prevented from occurring during the sheet feeding operation. Further, the image recording apparatus according to the second exemplary embodiment uses the two threshold values in the preceding skew detection operation to determine whether the image recording can be executed. Thus, when an operator sets the continuous sheet P nearly straight, the determination that the image recording can be executed can be made only through the preceding skew detection operation so that the skew detection operation can be omitted. This can reduce the sheet feeding time.

In an image recording apparatus according to a third exemplary embodiment of the present invention, a threshold value for use in the preceding skew detection operation is set according to the width of the continuous sheet P. This allows a more accurate determination of the possibility of occurrence of paper jams. The image recording apparatus according to the third exemplary embodiment will be described below, focusing mainly on the points that are different from those of the image recording apparatuses according to the first and second exemplary embodiments.

When the pair of LF rollers 9 and 10 conveys the continuous sheet P while back tension is applied to the continuous sheet P, if the continuous sheet P is skewed, one edge of the continuous sheet P in the width direction becomes loose and the other edge becomes tense. The back tension (BT) is low on the loose side and high on the tense side. Meanwhile, the conveyance force (F) generated when the pair of LF rollers 9 and 10 nips and conveys the continuous sheet P is approximately constant in the width direction of the continuous sheet P. Accordingly, the net conveyance force P (=F−BT) is large on the loose side of the continuous sheet P and small on the tense side of the continuous sheet P. This causes the continuous sheet P to rotate from the tense side to the loose side. A force for the rotation becomes a skew correction force. Due to the skew correction force, the continuous sheet P slides to move between the LF rollers 9 and 10 in the direction in which the skew is corrected. Thus, the skew of the continuous sheet P that can easily slide through the nip portion of the pair of LF rollers 9 and 10 can be corrected more easily. Further, the skew of the continuous sheet P that has a smaller width can be corrected more easily, because such a continuous sheet P can slide more easily through the nip portion of the pair of LF rollers 9 and 10.

When the same back tension is applied to roll paper having different widths, the level of skew correction differs. Hence, the image recording apparatus according to the third exemplary embodiment uses different threshold values according to the width of the continuous sheet P in the preceding skew detection operation to determine whether to execute the skew detection operation.

Figure 11:
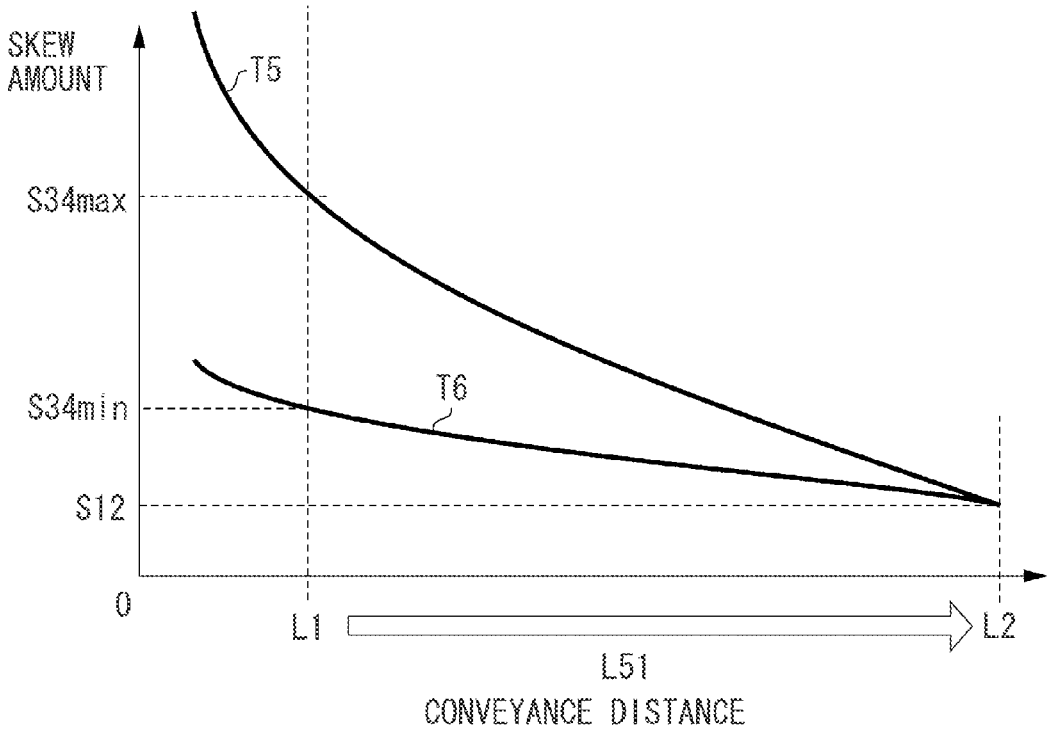
FIG. 11 is a figure illustrating a relationship between a conveyance distance of a continuous sheet P and a skew amount of the continuous sheet P.

FIG. 11 illustrates the relationship between the conveyance distance and skew amount of the continuous sheet P. In FIG. 11, a line T5 indicates the case in which the continuous sheet P has a smallest width that can be held by the holding unit 3 (254 mm in the third exemplary embodiment) and the skew amount calculated in the skew detection operation is the threshold value S12. A line T6 indicates the case in which the continuous sheet P has a largest width that can be held by the holding unit 3 (610 mm in the third exemplary embodiment) and the skew amount calculated in the skew detection operation is the threshold value S12. The threshold value S12 refers to a skew amount from which it can be determined that the image recording can be normally executed without causing ink to be discharged outside the continuous sheet P in the image recording. In FIG. 11, a threshold value S34max is a value that is set in the preceding skew detection operation when the roll paper R has the smallest width. The threshold value S34min is a threshold value that is set in the skew detection operation when the roll paper R has the largest width. As described above, the skew of the continuous sheet P that has a smaller width is corrected more easily while the continuous sheet P is conveyed in shifting from the preceding skew detection operation to the skew detection operation. In the preceding skew detection operation, therefore, a higher threshold value is set for the continuous sheet P having a smaller width.

In the image recording apparatus according to the third exemplary embodiment, the first skew amount calculated in the first skew detection operation is compared with the threshold value that is set according to the width of the continuous sheet P so that the skew transition thereafter can be predicted. If the skew amount at the time when the conveyance distance of the continuous sheet P with the smallest width reaches a distance L1 is smaller than the threshold value S34max, it can be predicted that no defective feeding such as a paper jam will not occur even if the conveyance distance reaches a distance L2 in the skew detection operation. If the skew amount at the time when the conveyance distance of the continuous sheet P with the largest width reaches the distance L1 is smaller than the threshold value S34min, it can be predicted that no defective recording will occur even if the conveyance distance reaches the distance L2 in the skew detection operation.

Figure 12:
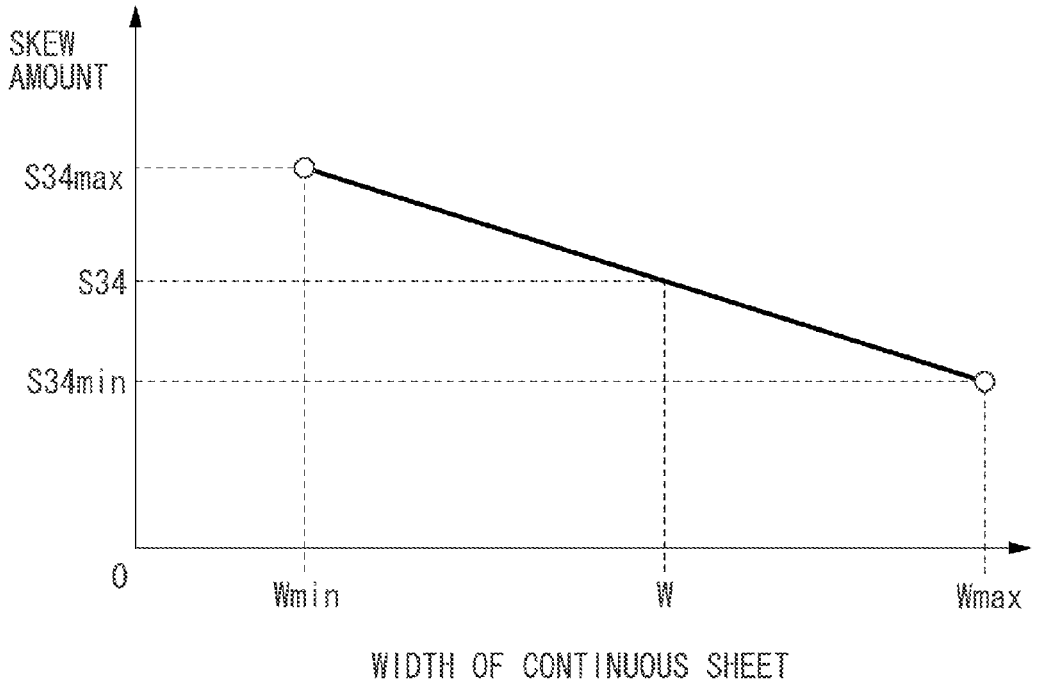
FIG. 12 is a figure illustrating a relationship between a width of a continuous sheet P and threshold values of a skew amount.

FIG. 12 illustrates the relationship between the width of the continuous sheet P and the threshold value of the skew amount. In the third exemplary embodiment, the threshold value of the skew amount is set according to the width of the continuous sheet P based on the proportional relationship shown in FIG. 12.

Figure 13A:
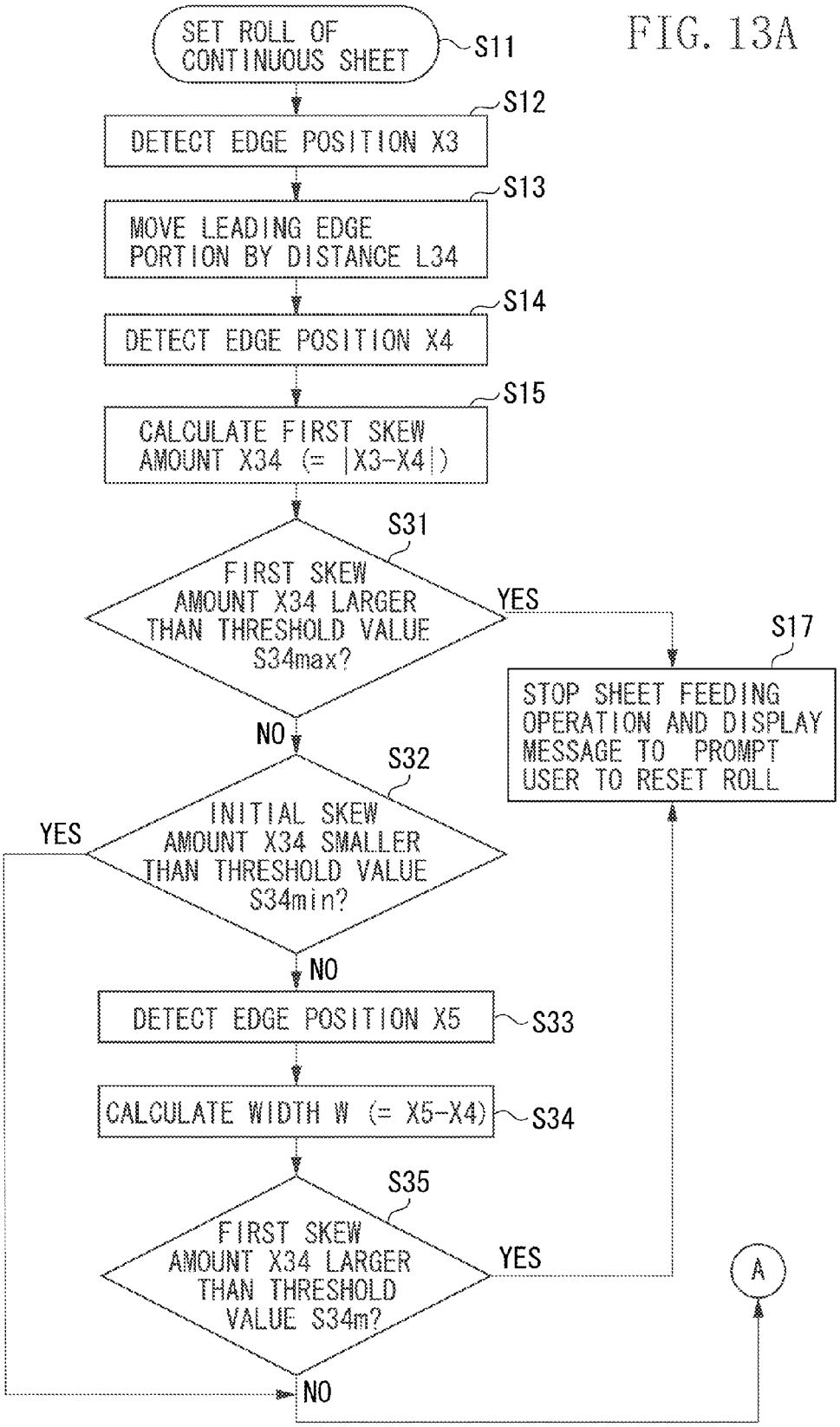
FIGS. 13A and 13B are a flowchart illustrating a procedure of sheet feeding operation by an image recording apparatus according to a third exemplary embodiment of the present invention.
Figure 13B:
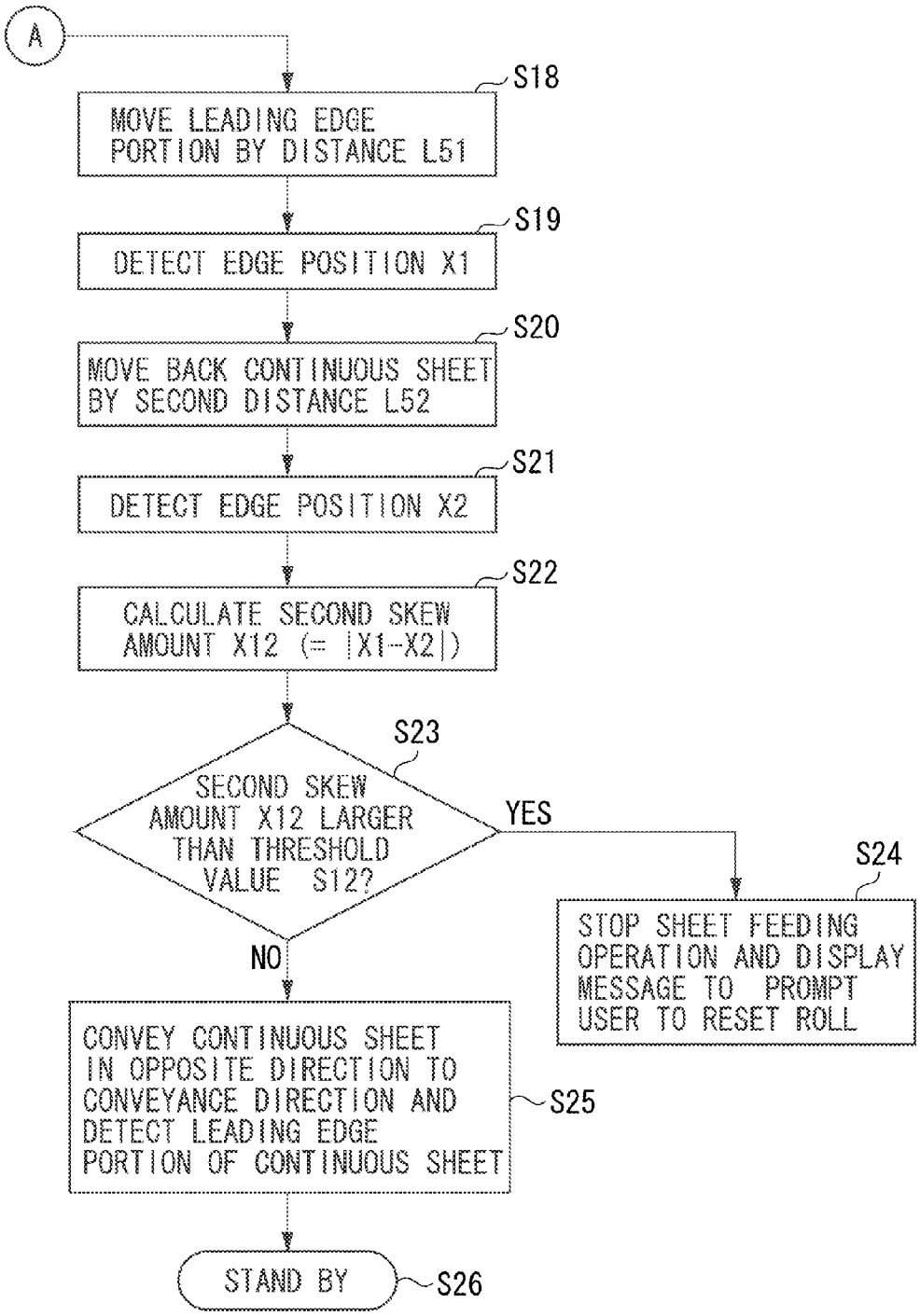
Figures 14A, 14B, 14C, 14D, 14E:
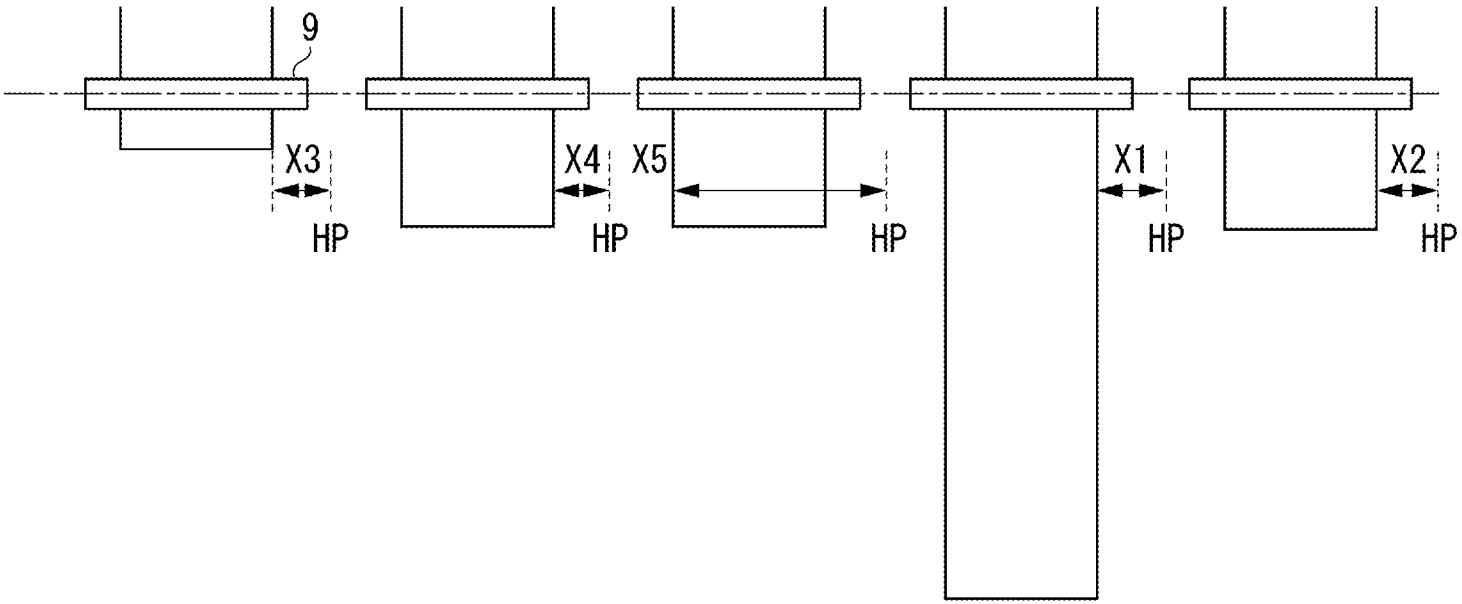
FIGS. 14A, 14B, 14C, 14D, and 14E are views illustrating detection positions of a continuous sheet P in the sheet feeding operation in the third exemplary embodiment.

FIGS. 13A and 13B are a flowchart illustrating a procedure of sheet feeding operation by the image recording apparatus according to the third exemplary embodiment. FIGS. 14A, 14B, 14C, 14D, and 14E illustrate detected positions of the continuous sheet P in the sheet feeding operation according to the third exemplary embodiment.

Steps S11 to S15 and S18 to S24 in the flowchart illustrated in FIGS. 13A and 13B are similar to those in the first exemplary embodiment, so that the description thereof is omitted.

In step S31, after the control unit 101 calculates the first skew amount X34 (first displacement amount) in step S15, the control unit 101 determines whether the first skew amount X34 is larger than the threshold value S34max. In the third exemplary embodiment, the threshold value S34max is 4.0 mm and stored in advance in the storage unit 102.

If the first skew amount X34 is larger than the threshold value S34max (YES in step S31), a paper jam is more likely to occur during the second skew detection operation or it is more likely to be determined in the second skew detection operation that the image recording cannot be executed, regardless of the width of the continuous sheet P. In step S17, the control unit 101 stops the sheet feeding operation and displays on the display unit 7 a message to prompt the user to reset the roll paper R.

On the other hand, if the first skew amount X34 is equal to or smaller than the threshold value S34max (NO in step S31), then in step S32, the control unit 101 determines whether an initial skew amount X34 is smaller than the threshold value S34min. In the third exemplary embodiment, the threshold value S34min is 2.0 mm and stored in advance in the storage unit 102.

If the initial skew amount X34 is smaller than the threshold value S34min (YES in step S32), defective sheet feeding such as a paper jam is less likely to occur in the skew detection operation, regardless of the width of the continuous sheet P. In this case, the control unit 101 proceeds to step S18.

On the other hand, if the skew amount X34 is equal to or larger than the threshold value S34min (NO in step S32), the control unit 101 causes a width detection unit to calculate the width of the continuous sheet P. Specifically, the width detection unit includes the carriage 12 and the sheet edge detection sensor 43. The control unit 101 drives the carriage motor 61 to move the carriage 12 in the scanning direction. In step S33, as the carriage 12 is moved, the sheet edge detection sensor 43 detects an edge position X5 of the continuous sheet P (refer to FIG. 14C). The edge position X5 is located on the opposite side to the edge position X4 detected in step S14. In step S34, the control unit 101 calculates a difference between the edge position X5 and the edge position X4 to obtain the width W of the continuous sheet P.

In step S35, the control unit 101 determines whether the first skew amount X34 calculated in step S15 is larger than the threshold value S34*m* (skew threshold value). The threshold value S34*m* is a value corresponding to a width W in the proportional relationship shown in FIG. 12. The control unit 101 calculates the threshold value S34*m* by use of the proportional relationship shown in FIG. 12.

If the first skew amount X34 is larger than the threshold value S34*m* (YES in step S31), a paper jam is more likely to occur in the second skew detection operation. Therefore, in step S17, the control unit 101 stops the sheet feeding operation and displays on the display unit 7 a message to prompt the user to reset the roll paper R.

On the other hand, if the difference X34 is equal to or smaller than the threshold value S34*m* (NO in step S35), defective sheet feeding such as a paper jam is less likely to occur in the second skew detection operation. In this case, the control unit 101 proceeds to step S18.

As described above, the image recording apparatus according to the third exemplary embodiment determines the threshold value of the skew amount according to the width of the continuous sheet P in the preceding skew detection operation. This allows a more accurate determination of whether defective sheet feeding such as a paper jam will occur in the second skew detection operation.

In the third exemplary embodiment, whether to execute the second skew detection operation is determined after the detection of the edge position X5 in step S33 and the calculation of the width W of the continuous sheet P in step S34. In the third exemplary embodiment, however, whether to execute the second skew detection operation may be determined during the detection of the edge position X5 in step S33. Specifically, the control unit 101 calculates a width W1 corresponding to the first skew amount X34 by use of the proportional relationship illustrated in FIG. 12, and calculates an edge position (=W+X4) where the first skew amount falls within an allowable range. Then, the control unit 101 may determine that the skew detection operation is to be executed if the edge position X5 actually detected by the sheet edge detection sensor 43 is within the allowable range.

In the third exemplary embodiment, the sheet edge detection sensor 43 functions as a width identification unit for detecting the width of the continuous sheet P. In the third exemplary embodiment, however, data indicating the width of the continuous sheet P that has been input in advance from the host computer 100 may be stored in the storage unit 102 to detect the width of the continuous sheet P. Alternatively, the conveyance path 4 may include a sensor so that the sensor automatically detects the width of the roll paper R.

In the third exemplary embodiment, two sets of data of a table showing a plurality of widths W of the continuous sheet P and the skew amount threshold values S34*m* that correspond to the respective widths W are stored in the storage unit 102. Table 1 shows an example of a table of the threshold values.

TABLE 1

| Width of roll paper R | W1 | W2 | W3 | W4 |
|---|---|---|---|---|
| Threshold value of skew amount | S34m1 | S34m2 | S34m3 | S34m4 |

If the width detected by the sheet edge detection sensor 43 is not specified in the two sets of data, the control unit 101 calculates the threshold value S34*m* by use of the proportional relationship between the two sets of data. In the third exemplary embodiment, however, three or more sets of data showing the widths of the continuous sheet P and the skew amount threshold values corresponding to the respective widths may be stored in the storage unit 102. Further, when the type of the width of the continuous sheet P is predetermined, an individual threshold value for each width may be stored in the storage unit 102.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-015300 filed Jan. 30, 2013, which is hereby incorporated by reference herein in its entirety.

What is claimed is:

1. A sheet feeding apparatus comprising:

a conveyance unit configured to convey a sheet supplied from a holding unit;

a sensor configured to detect an edge of the sheet in a width direction;

a width detection unit configured to detect a width of the sheet;

a storage unit configured to store at least two sets of data of threshold values corresponding to widths of the sheet; and a control unit configured to detect, with the sensor, a displacement of the edge of the sheet in the width direction during movement of the sheet by a predetermined distance, and to cancel a subsequent skew detection operation if the displacement is larger than an allowable amount, wherein the control unit uses the at least two sets of data stored in the storage unit to set a skew threshold value with which the displacement is to be compared, and wherein if the at least two sets of data do not contain a threshold value corresponding to the width of the sheet detected by the width detection unit, the control unit calculates the skew threshold value by using the at least two sets of data of threshold values corresponding to the widths of the sheet.

2. The sheet feeding apparatus according to claim 1, wherein if the displacement is smaller than a first threshold value and larger than a second threshold value, which is smaller than the first threshold value, the control unit executes the subsequent skew detection operation, and if the displacement is smaller than the second threshold value, the control unit cancels the subsequent skew detection operation.

3. The sheet feeding apparatus according to claim 1, further comprising:

a carriage including the sensor and configured to move in a direction perpendicular to a conveyance direction of the conveyance unit, wherein as the carriage moves, the sensor detects edge positions of both edges of the sheet in the width direction so that the width detection unit detects the width.

4. The sheet feeding apparatus according to claim 1, further comprising:

a notification unit configured to give a notification to prompt a user to reset the sheet if the control unit cancels the skew detection operation.

5. The sheet feeding apparatus according to claim 1, wherein the control unit executes the skew detection operation by detecting, with the sensor, a displacement of the edge of the sheet in the width direction during movement of the sheet by a distance that is larger than the predetermined distance.

6. The sheet feeding apparatus according to claim 5, wherein if the displacement of the edge of the sheet detected in the skew detection operation is larger than a predetermined value, the control unit gives a notification to prompt a user to reset the sheet.

7. The sheet feeding apparatus according to claim 5, wherein the control unit executes the skew detection operation by detecting, with the sensor, a displacement of the edge of the sheet in the width direction during movement of the sheet by a distance that is larger than the predetermined distance in a direction to move back the sheet to the holding unit after conveyance of the sheet with back tension applied thereto.

8. A sheet feeding apparatus comprising:

a conveying unit configured to perform conveying operations of a sheet supplied from a holding unit in a predetermined direction, wherein the conveying operations include at least a first conveying operation by a first conveying amount and a second conveying operation by a second conveying amount which is larger than the first conveying amount, the second conveying operation being performed after the first conveying operation is performed;

a detecting unit configured to detect a position of an edge of the sheet in a crossing direction which crosses to the predetermined direction;

an obtaining unit configured to obtain a first displacement of positions of the edge detected by the detecting unit before and after performing the first conveying operation by the conveying unit, and a second displacement of positions of the edge detected by the detecting unit before and after performing the second conveying operation by the conveying unit; and a determining unit configured to determine whether a printing operation to the sheet is performed or not such that (i) the printing operation is not performed in a case where the first displacement obtained by the obtaining unit is larger than a first threshold value, (ii) the printing operation is not performed in a case where the first displacement obtained by the obtaining unit is smaller than the first threshold value and the second displacement obtained by the obtaining unit is larger than a second threshold value, and (iii) the printing operation is performed in a case where the first displacement obtained by the obtaining unit is smaller than the first threshold value and the second displacement obtained by the obtaining unit is smaller than the second threshold value.

9. The sheet feeding apparatus according to claim 8, wherein the first threshold value is smaller than the second threshold value.

10. The sheet feeding apparatus according to claim 8, wherein the determining unit determines that (i) the printing operation is performed, regardless of the second displacement, in a case where the first displacement obtained by the obtaining unit is smaller than a third threshold value which is smaller than the first threshold value, (ii) the printing operation is not performed in a case where the first displacement obtained by the obtaining unit is smaller than the first threshold value and larger than the third threshold value, and the second displacement obtained by the obtaining unit is larger than the second threshold value, and (iii) the printing operation is performed in a case where the first displacement is smaller than the first threshold value and larger than the third threshold value, and the second displacement obtained by the obtaining unit is smaller than the second threshold value.

11. The sheet feeding apparatus according to claim 8, further comprising:

an outputting unit configured to output predetermined information in a case where the determining unit determines that the printing operation is not performed.

12. The sheet feeding apparatus according to claim 11, wherein the outputting unit outputs a notification to prompt a user to reset the sheet as the predetermined information in a case where the determining unit determines that the printing operation is not performed.

13. The sheet feeding apparatus according to claim 8, wherein the determining unit determines that the second conveying operation by the conveying unit is not performed in a case where the first displacement obtained by the obtaining unit is larger than the first threshold value.

14. The sheet feeding apparatus according to claim 8, further comprising:

a printing head used for performing the printing operation by ejecting ink to the sheet.

15. The sheet feeding apparatus according to claim 8, wherein the detecting unit is an optical sensor which optically detects the position of the edge of the sheet in the crossing direction.

16. A sheet feeding method executed by a sheet feeding apparatus, the method comprising:

a conveying step of performing conveying operations of a sheet supplied from a holding unit in a predetermined direction, wherein the conveying operations includes at least a first conveying operation by a first conveying amount and a second conveying operation by a second conveying amount which is larger than the first conveying amount, the second conveying operation being performed after the first conveying operation is performed;

a detecting step of detecting a position of an edge of the sheet in a crossing direction which crosses to the predetermined direction;

an obtaining step of obtaining a first displacement of positions of the edge detected in the detecting step before and after performing the first conveying operation in the conveying step, and a second displacement of positions of the edge detected in the detecting step before and after performing the second conveying operation in the conveying step; and a determining step of determining whether a printing operation to the sheet is performed or not such that (i) the printing operation is not performed in a case where the first displacement obtained in the obtaining step is larger than a first threshold value, (ii) the printing operation is not performed in a case where the first displacement obtained in the obtaining step is smaller than the first threshold value and the second displacement obtained in the obtaining step is larger than a second threshold value, and (iii) the printing operation is performed in a case where the first displacement obtained in the obtaining step is smaller than the first threshold value and the second displacement obtained in the obtaining step is smaller than the second threshold value, wherein a controller in the sheet feeding apparatus executes at least one of the conveying, detecting, obtaining and determining steps.

17. The sheet feeding method according to claim 16, further comprising:

a printing step of performing the printing operation by ejecting ink to the sheet.

* * * * *